United States Patent [19]

Einstabland et al.

[11] Patent Number: 4,481,899

[45] Date of Patent: Nov. 13, 1984

[54] FLOATING PLATFORM STRUCTURE

[75] Inventors: Tomas B. Einstabland, Asker; Olav Olsen, Lysaker, both of Norway

[73] Assignee: Ingenior F. Selmer A/S, Oslo, Norway

[21] Appl. No.: 426,043

[22] Filed: Sep. 28, 1982

[30] Foreign Application Priority Data

Oct. 7, 1981 [NO] Norway ..... 813389

[51] Int. Cl.[3] ..... B63B 35/44; B63B 35/33

[52] U.S. Cl. ..... 114/264; 114/258; 114/261; 405/195

[58] Field of Search ..... 114/264, 265, 266, 258, 114/259, 267, 260, 261, 292, 123, 45, 49, 40; 405/195, 196–209

[56] References Cited

U.S. PATENT DOCUMENTS

| | | | |
|---|---|---|---|
| Re. 29,413 | 9/1977 | Hekkanen et al. | 114/265 |
| 1,511,153 | 10/1924 | Armstrong | 114/265 |
| 1,670,524 | 5/1928 | Sachs | 114/261 |
| 1,773,999 | 8/1930 | Haight | 114/123 |
| 1,885,889 | 11/1932 | Beam | 114/264 |
| 2,399,611 | 5/1946 | Armstrong | 114/265 |
| 3,464,212 | 9/1969 | Yamagata et al. | 114/267 |
| 3,507,239 | 4/1970 | Wipkink et al. | 114/265 |
| 3,592,155 | 7/1971 | Rosenberg | 114/265 |
| 3,785,313 | 1/1974 | Rosenberg | 114/265 |
| 3,785,313 | 1/1974 | Rosenberg | 114/266 |
| 3,931,778 | 1/1976 | Miller et al. | 114/264 |
| 4,275,679 | 6/1981 | Finsterwalder | 114/264 |
| 4,388,023 | 6/1983 | Cochrane | 405/195 |

FOREIGN PATENT DOCUMENTS

| | | | |
|---|---|---|---|
| 0015352 | 2/1981 | European Pat. Off. | 114/264 |
| 208472 | 6/1972 | Norway | 114/264 |
| 145444 | 1/1975 | Norway | 114/264 |
| 135897 | 12/1975 | Norway | 114/264 |
| 327441 | 4/1930 | United Kingdom | 114/264 |

*Primary Examiner*—Trygve M. Blix
*Assistant Examiner*—Patrick W. Young
*Attorney, Agent, or Firm*—Ladas & Parry

[57] ABSTRACT

Floating platform structure comprising a deck section and a support section supporting the deck section. The floating structure is manufactured in the shape of a trussed girder having an upper chord and a lower chord which are connected with one another by girder members and having a vertical cross section substantially in the shape of a triangle having an apex pointing downwardly, the deck section of the platform structure being provided by the upper chords of the girder. The buoyancy means of the platform structure are found in the upper portions of the girder members and the ballast means in the lower portions of the girder members and optionally in the lower girder chord. The support section comprises groups of at least three girder members each, said members converging from the deck downwardly towards a common point and being fixedly connected with one another in a junction point in or adjacent the convergency point. In an advantageous embodiment of the invention each group of girder members comprises four members presenting an upside down orientated pyramid, and two of the girder members in each pyramid meet two corresponding girder members of an adjacent girder member pyramid or group at the deck section.

8 Claims, 17 Drawing Figures

FLOATING PLATFORM STRUCTURE

BACKGROUND OF THE INVENTION

1. Field of the Invention

The present invention generally relates to a floating platform structure and more particularly to a floating air port structure. The structure, however, can be used for other purposes such as location for industrial activities at sea. The invention relates also to a method for erecting a structure of the above mentioned kind and structure modules which can be used in combination for building the structure in case.

2. Prior Arts

Floating structures having great dimensions and comprising deck section, float section and ballast section are formerly known. Most of them are formed as semi-floating structures generally comprising one or more float members supporting vertical columns which again support a deck structure. Frequently, diagonal bracing rods are arranged between the columns. The buoyancy is provided by the float members and partly by the columns. Therefore, the float members must be divided into water-tight compartments and provided with piping systems for draining and ballasting. It may be referred to U.S. Pat. No. 1,670,524, 3,592,155, 3,785,313 and 4,275,679.

THE PURPOSE OF THE INVENTION

The purpose of the invention is to provide a floating structure particularly a floating air port platform structure which can be produced in an economical manner and allows for easy maintenance and operation.

A particular purpose of the invention is to provide a floating platform structure having a deck section and a support section, the structure being formed as a longitudinal trussed girder having an upper and a lower girder chord which are connected by girder members, said trussed girder having a vertical cross section in shape of a triangle or approximated triangle, the base of which is facing upwardly, and the upper chord of which is providing the said deck section, the float means of the platform arranged in the upper portion of the girder members and the ballasting means arranged in the lower portion of the girder members and optionally in the lower chord.

A further purpose of this invention is to provide a floating platform structure of the kind defined above which can be easily barged across the sea, if necessary, even during rough weather conditions and which can adjust itself successfully when in moored condition. Further, the cross sectional shape of the platform support structure shall provide for progressive damping of the platform movements owing to the waves.

FURTHER OBJECTS OF THE INVENTION

A platform structure according to the invention comprises a support section having a succession of groups of at least three girder members in each group, said girder members converging from the deck downwardly towards a common point and being fixedly connected with one another at a junction point in or adjacent said convergency point.

Generally, the lower chord comprises at least one pipe as stress absorbing member.

A bracing plate is preferably connecting the girder member at a distance upwardly from their lower jointed ends.

A floating platform structure according to the invention may comprise two trussed girder structures arranged side by side and fixedly connected with one another, each girder structure having upper and lower chords which are connected with one another by inclined girder members, and which girder structure has a vertical cross section in shape of a triangle or approximately tri-angle with basis thereof facing upwardly, the deck section providing the upper chord of the girder, the float means of the girder structure arranged in the upper portion of the inclined girder members and ballast means arranged in the lower portion of the girder members and optionally in the lower chord.

The invention contemplates also a platform structure module for producing a floating structure, said module comprising a deck section having polygonal plane view and supported by four or three columns extending downwardly from the deck and converging towards a junction point, the lower ends of the columns are connected with one another in or adjacent said junction point.

The columns of the module may be connected with one another by a bracing plate at a distance from their lower jointed ends. In a platform support section combined of groups having three girder members each, the junction points for each second group are preferably located on a straight line and the junction points for the intermediate groups are located on another straight line being parallel with the first line, the lower chord comprising two pipes of steel extending along one of said two lines, respectively.

These and other objects will fully appear from the following description with the accompanying drawings.

DETAILED DESCRIPTION OF THE INVENTION

Figure 1:
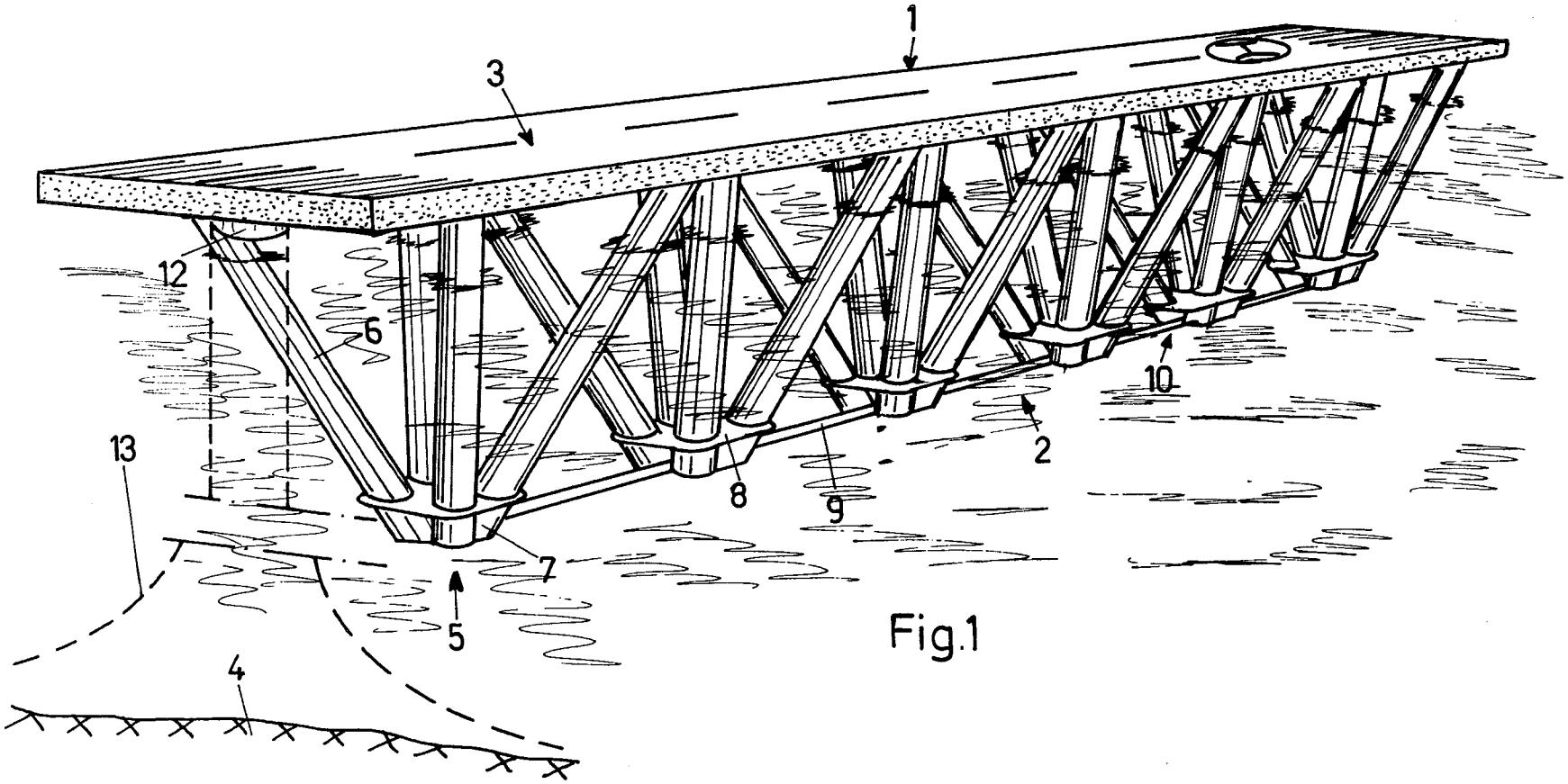
FIG. 1 is an isometric view of a floating platform structure formed in accordance with the invention for use as a floating air port.

FIG. 1 is an isometric perspective view of a platform structure incorporating the invention in shape of a floating air port. In the following the structure will be denoted as platform because basically, it is an offshore platform. The platform 1 comprises a support section 2 and a deck section 3. The support section 2 comprises a plurality of groups or modules 5 each comprising four inclined columns 6. Geometrically, the columns in each group provide an upside down orientated pyramid with the upper ends of the columns located at the longitudinal side edges of the deck section 3. The columns in each group are converging downwardly towards a common junction point or convergency point 7 located somewhat higher than the geometrical junction point not appearing in the drawing. In the embodiment according to this example the platform is constructed of prestressed or reinforced concrete and the lower end portions of the columns 6 are cast together in the junction point 7. At some distance upwardly from the junction point a horizontal bracing plate 8 is arranged cast monolytic with the columns 6. The columns are cylindric pipes of reinforced concrete. The upper ends of the columns 6 are connected integrally by concrete casting with the deck section 3. Between the junction points 7 and the support section 2 pressure and tension absorbing structural elements 9 are arranged extending in the longitudinal direction of the platform. The structural elements 9 consist of steel pipes filled with concrete and provide a continuous member or chord 10 extending from one end of the support section to the other.

Figure 2:
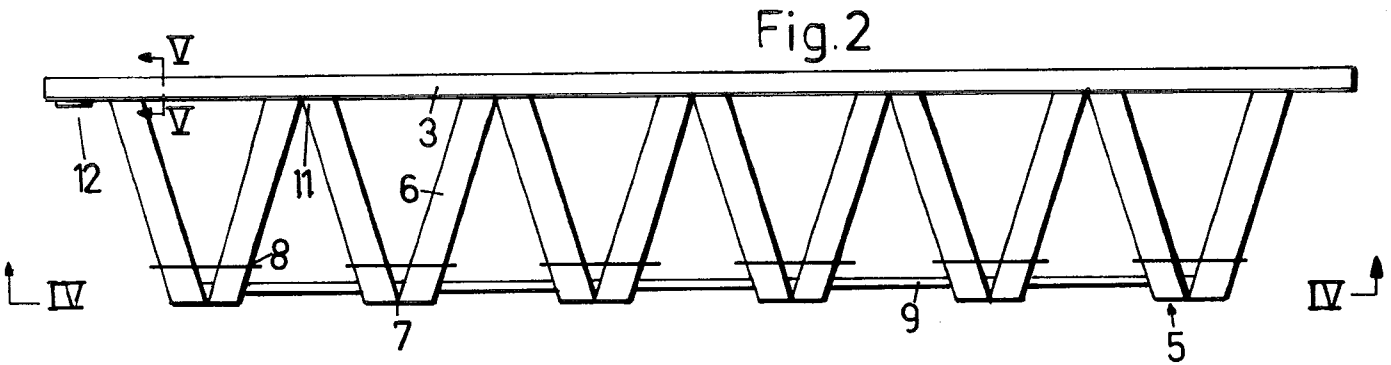
FIG. 2 is a schematic side elevation view of the structure of FIG. 1.
Figure 3:
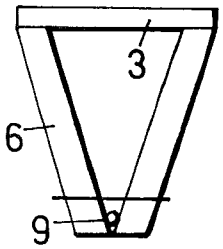
FIG. 3 is an end elevation view of the structure of FIG. 2.
Figure 4:
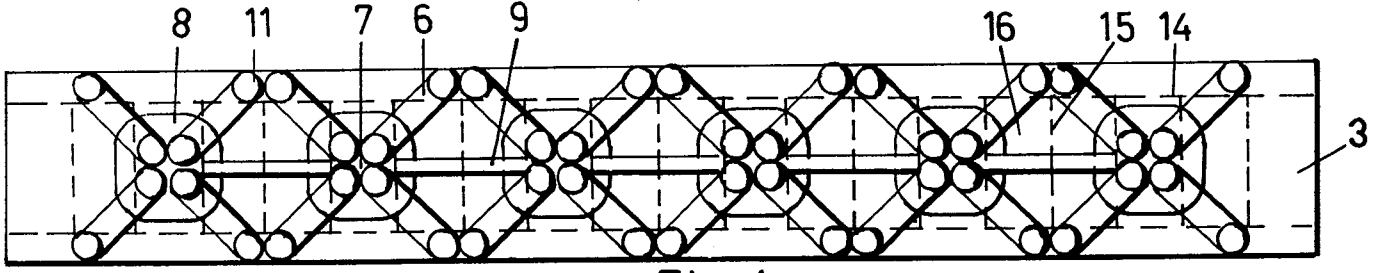
FIG. 4 is a bottom view of the structure of FIG. 1.

FIG. 2 is an elevation of the platform and FIG. 3 is an end view of the platform. It appears clearly from FIGS. 1–3 that the platform 1 is formed as a trussed girder the upper chord of which consists of the deck section 3 and the lower chord of which consists of the pipe 9,10. The chords are connected with one another by diagonal girder members 6. It appears from the FIGS. 1–3 that in side elevation and in end or front elevation the diagonal girder members define a triangle-shaped area. FIG. 4 is a plane view of the platform and it appears from the Figure that the diagonal girder members or columns 6 in the adjacent groups pairwisely meet one another at their upper ends where they provide junction points 11 similar to the junction points 7 of the lower chord.

At one end of the deck section 3 a pivotable anchoring device 12 is arranged on the underside of the deck for a plurality of anchoring chains 13 for anchoring the platform to the sea bottom 4 (FIG. 1).

In FIG. 4 the longitudinal beams of the deck section 3 are indicated by stretched lines 14 and the cross beams of the deck section by stretched lines 15.

Figure 5:
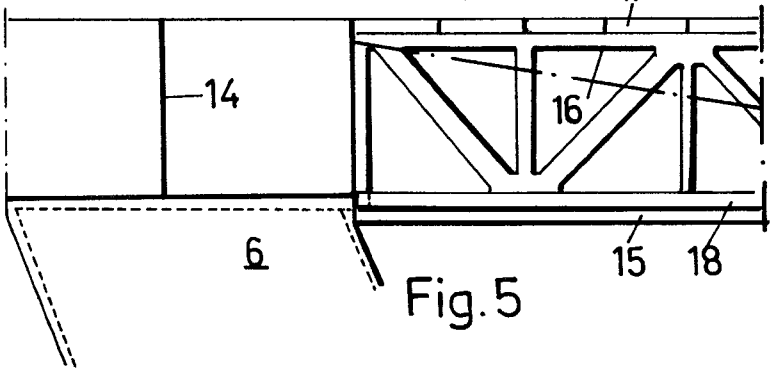
FIG. 5 is a cross sectional vertical view taken along the line V—V in FIG. 2, showing at a larger scale a portion of the structure deck and of the top of one of the columns.

In FIG. 5 the adjacent portions of an inclined column 6 and the deck section 3, respectively, are shown in a cross sectional view along the line V—V in FIG. 2. Also a cross beam 15 is indicated by way of example. The inclined column 6 ends with a horizontal surface carrying the longitudinal beam 14. Said beam is formed in shape of a box girder. The longitudinal beam does not cover completely the top surface of the inclined column to provide support areas for overlap mounting of the end portion of a longitudinal beam or a similar member of an adjacent platform module (see the method of erecting the platform disclosed below). The cross beam 15 is formed as a trussed girder having upper and lower chords and vertical trussed girder members and diagonal girder members. Between the beams and on the beams deck plating sections 16 of suitable embodiment are located (see also FIG. 4). The deck slabs 16 provide the upper deck proper 17 of the deck section. The deck section can also be provided with a lower deck 18 as indicated schematically at left in FIG. 5.

Figure 7:
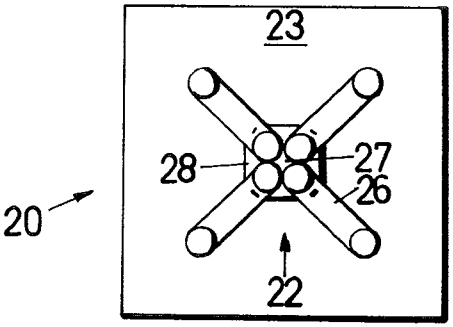
FIG. 7 is a schematic plane view of the module of FIG. 6.
Figure 8:
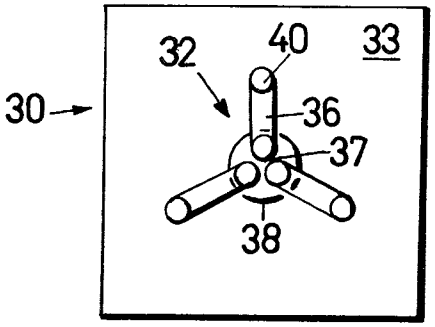
FIG. 8 is a plane view of an alternative embodiment of the structure module of FIG. 6.
Figure 6:
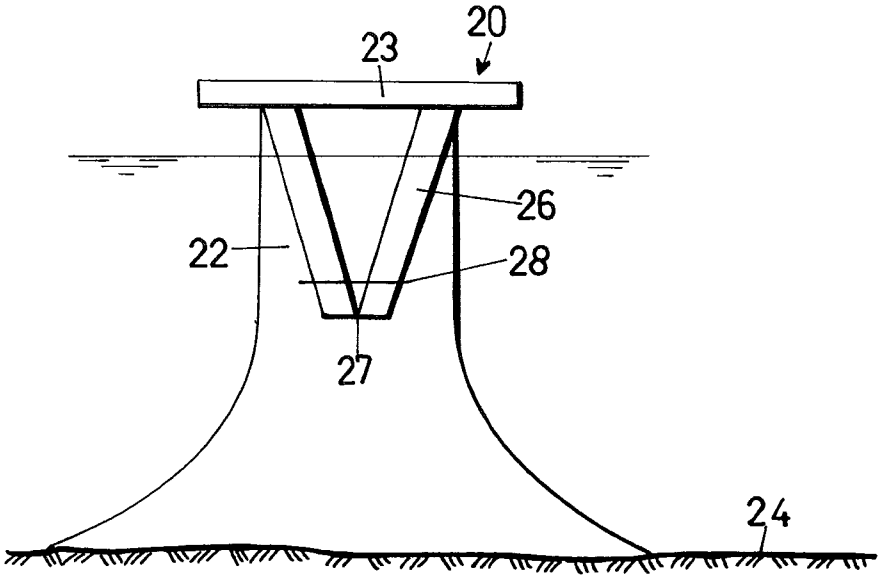
FIG. 6 is a front elevation or side elevation view of a structure module.

As it will be described more closely with reference to FIG. 10 the platform is built up of a plurality of units or modules. According to FIG. 1 the platform is comprising six such modules. FIGS. 6–8 show that a platform module can be fitted out as to provide an independent platform by itself. Such a platform module 20 is shown in FIG. 6, and FIG. 7 is the plane view of the module. In this particular case the deck section 23 of the platform is formed with a greater width than in the embodiment of FIG. 1 and the platform is anchored in the sea bottom by means of chains secured to the deck. The inclined columns are denoted by 26, the lower bracing plate by 28 and and the lower junction point by 27. The support section is, therefore, similar to the support section 3 of FIGS. 1–4 apart from the fact that there are no lower chord members 9,10. In FIG. 8 another embodiment 30 of the platform module is shown having the supporting section 32 shaped with triangular plane view, i.e. as a geometric tetraeder. The support section comprises three inclined columns. 36 converging downwardly towards a junction point 37, the upper ends 40 of the columns being cast together in concrete with the deck section 33. FIGS. **9*a* and 9*b* show schematically a plane view and an end view of a portion of a platform structure built up of a plurality of platform modules 30 having a support section as shown in FIG. 8. The inclined columns are indicated by 36 and the deck section by 33**. (See also below)

Figure 10B:
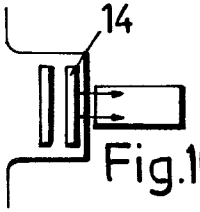
Figure 10F:
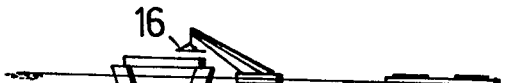
Figure 10A:
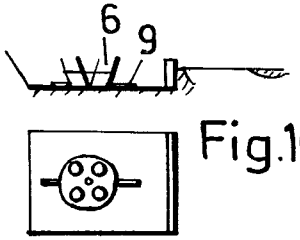
Figure 10E:
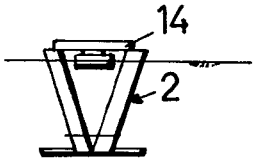

Production and erection of a floating platform as shown in FIG. 1 will now be described shortly with reference to FIGS. **10 *a–g*. FIG. 10*a* shows a schematic cross section of a dry dock where casting of a support section module 5 has been started. The lower junction point, sections of the lower chord 10 and the lower bracing plate 8 are indicated. Upon completing the lower support portion of the support section module this lower portion is towed out from the dock into deeper water. At another location the longitudinal beams 14 (FIG. 10*b*), the cross beams 15 and the deck slabs 16 for the deck sections are manufactured. The lower portion of the support section is barged out into deeper water (FIG. 10*e*) and casting of the inclined columns is completed by slip-form-casting. When completed, the columns of the support section of the module, the longitudinal beams and the cross beams of the deck section are floated or transported to the location of the floating support section which is submerged to a suitable depth and the longitudinal beams and the cross beams are mounted on the support section. Then the deck slabs and other outfit which is necessary or desirable on the platform at this time is lifted on board (FIGS. 10*e* and 10*f***). The components of the platform module are connected with one another by concrete casting.

When a plurality of platform modules have been completed the modules are placed in succession after one another as illustrated in FIG. **10*g*** and connected with one another at the top by concrete casting between the columns and the longitudinal beams (if desirable with mounting of additional intermediate members) and the lower ends of the support section modules are connected by welding together the ends of the lower chord pipes which are of steel. The welding is performed under water using a dry work chamber. After welding, the pipes are covered with concrete and when all deck slab sections are in location the possible joints and interspaces are filled with concrete to complete the main structure.

It will be clear to the experts that all portions or members of the structure which shall be connected with one another (by concrete casting) are provided during the manufacturing with means (such as projecting reinforcing irons, anchors, hinge irons, etc.) which make the composing and together casting of the adjacent structure elements more simple and easy. Such techniques are formerly known in connections with producing concrete platforms. It is not necessary that all support section units are completely out-fitted before combining with the deck section members. It can be sufficient that some of the units only are fitted with complete longitudinal beams and cross beams, whereas others can be provided with portions of them only, or such deck section members can be mounted upon the support sections having been combined together.

In the examples a longitudinal floating platform comprising a plurality of units has been disclosed with the units arranged in a row one after another, but it will appear that it is also possible to build up a platform by arranging a plurality of platform modules both after one another and laterally of one another to provide a floating structure having great length and great width. In such a case it may be necessary to provide the support sections at their lower ends with two lower chord sections extending at an angle with one another to provide junction means in the longitudinal and in the transversal direction. In an embodiment in accordance with FIG. 9 with tetrahedral-shaped modules it may be suitable to connect the section modules pairwisely with one another before mounting the longitudinal beams, etc. In a floating structure having a deck section with one deck only, the crew facilities, storing rooms, machine rooms, etc. can be placed in the longitudinal beams if it is desirable to keep the deck surface free. If the structure also comprises a lower deck said lower deck can be used for said purposes. In case of a floating airport a terminal for passengers will be arranged on the lower deck. If necessary, suitable building modules may be placed between the cross beams of the deck structure. The lower deck may accommodate hangars for aircrafts.

The drawings indicate anchoring of the floating structure by means of chains and anchors. However, it is also feasible that the floating structure is provided with power means such as diesel electric units which drive propelling motors either for complete positioning of the floating structure or as auxiliary for quick changing of the position of an anchored structure, e.g. because of the weather condition. The support for the anchoring chains (12, FIG. 2) is located on the underside of the deck and the dimensions are selected as to allow the structure to pivot freely 360°. In case of a concrete structure having a length of e.g. 600 meter and width of 90 meter and a depth up to 150 meter it can be necessary with e.g. 20 chains for safe anchoring of the structure. The structure is ballasted with sand and water filled into the lower portions of the inclined columns.

Figure 9B:
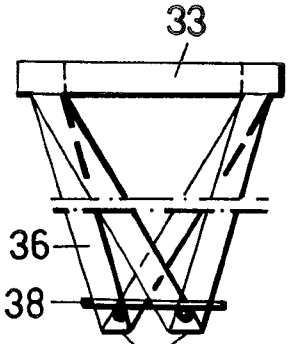
FIG. 9*b* is an end view of the structure of FIG. 9*a*.
Figure 10D:
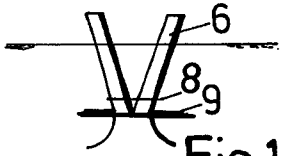
FIGS. 10 *a–g* illustrate a method of building and erecting a floating air port structure of the kind shown in FIG. 1.
Figure 10G:
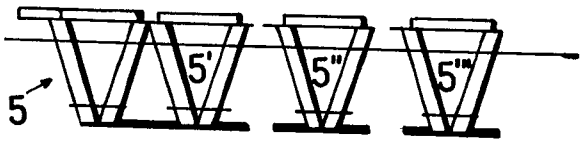
Figure 10C:
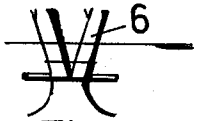
Figure 9A:
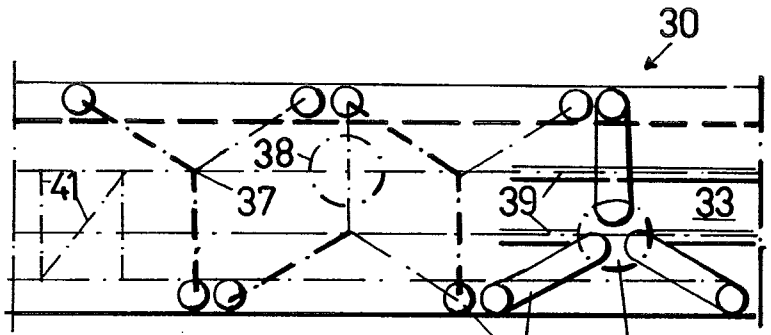
FIG. 9*a* is a schematic plane view corresponding to FIG. 4 of a platform structure consisting of structure modules according to FIG. 8.

In the embodiment shown in FIGS. 9*a* and 9*b* consisting of modules according to FIG. 8 the lower chord comprises two parallel pipes 39 and there are two geometric locations (two parallel lines) for the junction points 37 of the support sections. These two pipes can be connected with one another, e.g. by girder members 41.

The buoyancy of the platform structure is provided by inner cavities in the upper portions of the support columns 6. The lower portion cavities accommodate the ballast.

What is claimed is:

1. A floating platform structure in which:

a. an elongated deck section and a support section therefor are provided together comprising an open horizontal trussed girder wherein the deck section forms an upper chord and the support section has a lower chord and intermediate truss member;

b. said truss members are arranged in a contiguous rectilinear array of inverted tetralateral sided pyramid-shaped groups having a diagonal truss member in each descending pyramid edge;

c. each pyramid-shaped group has the truss members at the inverted base thereof rigidly connected to the underneath side of the deck section with one side of the base in one group substantially coinciding with the side of the base of the next adjacent group of the contiguous rectilinear array;

d. the lower end portions of the truss members in each inverted tetrahedral pyramid shaped group are rigidly connected with one another by lower junctions at the inverted pyramid apex the lower junctions of the tetrahedral pyrmid-shaped groups are connected to one another by said lower chord extending through all the lower junctions; and e. buoyancy means are provided in the upper portions of truss members and ballast means are provided in the lower portions of the truss members.

2. A platform structure according to claim 1, wherein said lower chord of the support section comprises a steel pipe constituting a stress absorbing member.

3. A platform structure according to claim 2, wherein ballast means is located in said steel pipe.

4. A platform structure according to claim 1, wherein the truss members in each inverted tetrahedral pyramidal group are connected to each other by a brace plate spaced upwardly from the lower junction.

5. A floating platform module structure, in which:

a. a deck member and a support section therefor are provided, together comprising an open trussed girder section wherein the deck member forms an upper chord section and the support section has a lower chord section and truss members between the upper chord section and the lower chord section;

b. the truss members are arranged in an inverted multilateral sided pyramid-shaped group having a diagonal truss member in each descending pyramid edge;

c. said pyramid-shaped group has the truss members at the inverted base thereof rigidly connected to the underneath side of the deck member;

d. the lower end portions of the truss members of the inverted equilateral pyramid-shaped group are rigidly connected with one another by a lower junction at the inverted pyramid apex; and e. buoyancy means are provided in the upper portions of truss members and ballast means are provided in the lower portions of the truss members.

6. A platform module structure module according to claim 5, wherein the truss members are connected to each other by a brace plate spaced upwardly from their lower junction.

7. A platform module structure according to claim 5, wherein the deck member is adapted to be connected at least one side thereof with another deck member of another platform module structure and the lower chord section is adapted to be fixedly connected to the corresponding lower chord section of said other platform module structure.

8. A method for producing a floating platform structure module of reinforced concrete, adapted to be connected with other similar modules to provide a structure having a deck section and a support section for the deck section, the structure formed as a trussed girder having an upper chord and a lower chord connected with one another by intermediate truss girder members, said trussed girder having a vertical cross section approximately in the shape of a triangle having the apex facing downwardly, wherein the truss members provide the triangle sides converging downwardly into a common joint, the deck section providing the upper chord of the trussed girder, buoyancy means in the upper portion of the girder members and ballast means in the lower portion of the girder members, said method comprising casting in a dry dock the lower portion of the platform structure module and subsequent barging out the cast module portion into deep water and casting the module portion to full height, the lower joint being completely cast in the dry dock with truss members diverging from the joints approximately along corner lines of an inverted pyramid.

* * * * *